United States Patent [19]

De Rossi

[11] 4,131,307

[45] Dec. 26, 1978

[54] AUTOMATIC HOOKING SAFETY-HOOK FOR DOORS OF DWELLINGS AND OFFICES

[76] Inventor: Rita De Rossi, Via del Trullo 60, Rome, Italy, 00100

[21] Appl. No.: 779,962

[22] Filed: Mar. 22, 1977

[30] Foreign Application Priority Data

Mar. 31, 1976 [IT] Italy ..... 48805

[51] Int. Cl.[2] ..... E05C 17/24

[52] U.S. Cl. ..... 292/268

[58] Field of Search ..... 292/262, 268, 270, 269, 292/285; 70/93

[56] References Cited

U.S. PATENT DOCUMENTS

| | | | |
|---|---|---|---|
| 355,419 | 1/1887 | Sprado | 292/268 |
| 1,497,500 | 6/1924 | Gorowitz | 292/268 X |
| 2,407,900 | 9/1946 | Paul | 70/93 |
| 2,704,684 | 3/1955 | Kleinemeier | 292/268 |
| 2,892,652 | 6/1959 | Johnson | 292/126 |

FOREIGN PATENT DOCUMENTS

| | | | |
|---|---|---|---|
| 431018 | 6/1926 | Fed. Rep. of Germany | 292/270 |

*Primary Examiner*—Richard E. Moore

*Attorney, Agent, or Firm*—Beveridge, De Grandi, Kline & Lunsford

[57] ABSTRACT

An automatic hooking safety-hook for doors of dwellings and offices comprising a rocking member mounted on the door frame and an eyed member mounted on the door and engaged with the rocking member, thus allowing the door to open only partially; disengaging means being provided, operable from outside and inside the door, to disengage the engaged members, in order to allow the door to open completely.

10 Claims, 6 Drawing Figures

FIG. 1.
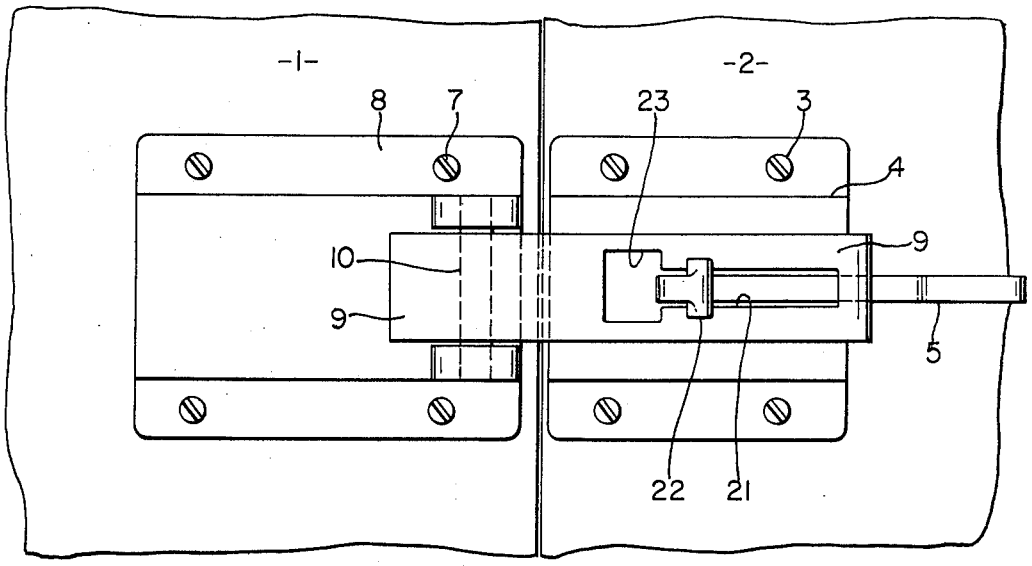
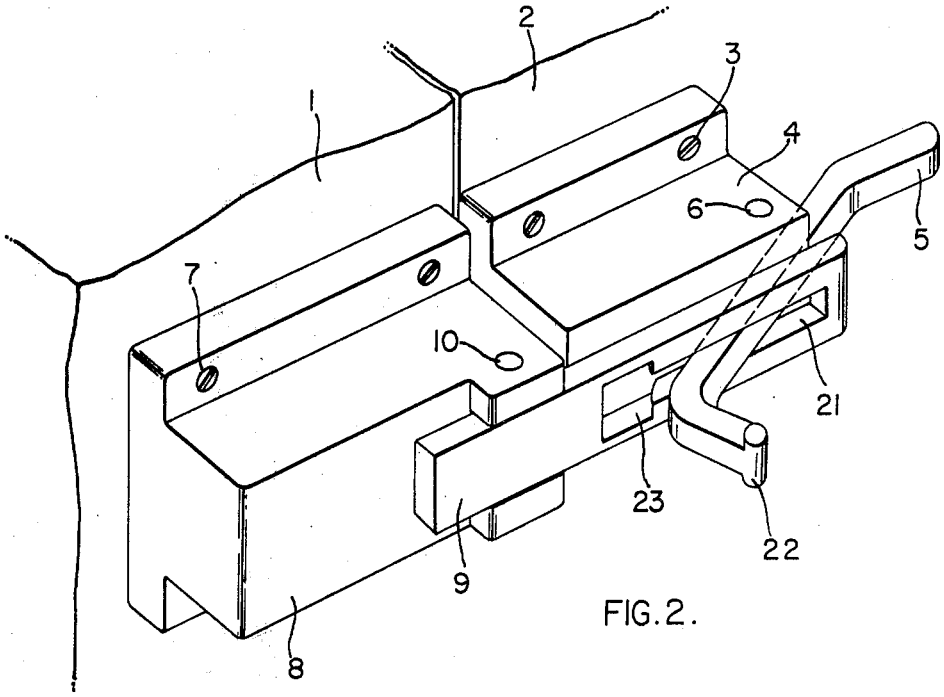
FIG. 2.

AUTOMATIC HOOKING SAFETY-HOOK FOR DOORS OF DWELLINGS AND OFFICES

This invention relates to an automatic hooking safety-hook for doors of dwellings and offices.

It is known that all the commercially available safety-hooks are at the present of the manual hooking type, namely these hooks are normally not-operating and it is necessary to operate the same all times before opening the door, in order to allow the door to open only partially, for identifying the ringing person.

Obviously, in many instances, as when children and aged or absent minded persons are opening the door without hooking the safety-hook, the lack of hooking the door safety-hook can result in annoying situations.

Accordingly, it is an object of the invention to provide a door safety-hook which is automatically hooked in all circumstances and can be released or only at will, namely only after the hook has duly operated.

According to the invention, a safety-hook is provided comprising a rocking member mounted on the door frame; an eye member, mounted on the door and engaged with the rocking member, thus allowing the door to open only partially; and externally and internally operable means to control disengagement of the two hook members, in order to allow to door to open completely.

The rocking member comprises a lever pivotally mounted on a supporting block secured to the inner side of the door frame and bearing an arm slidingly fitted in a slot on a slotted member, mounted on the door.

Moreover, according to the invention, the rocking member has a transversal element, keeping the two hook elements engaged during partial opening of the door, on the end of the guided arm.

This invention will be now more particularly disclosed making reference to the accompanying drawings showing a preferred embodiment thereof, for illustrative and not restrictive purposes.

In the drawings:

FIG. 1 is a front view of the device, from the door inner side;

FIG. 2 is a perspective view corresponding to FIG. 1;

Figure 3:
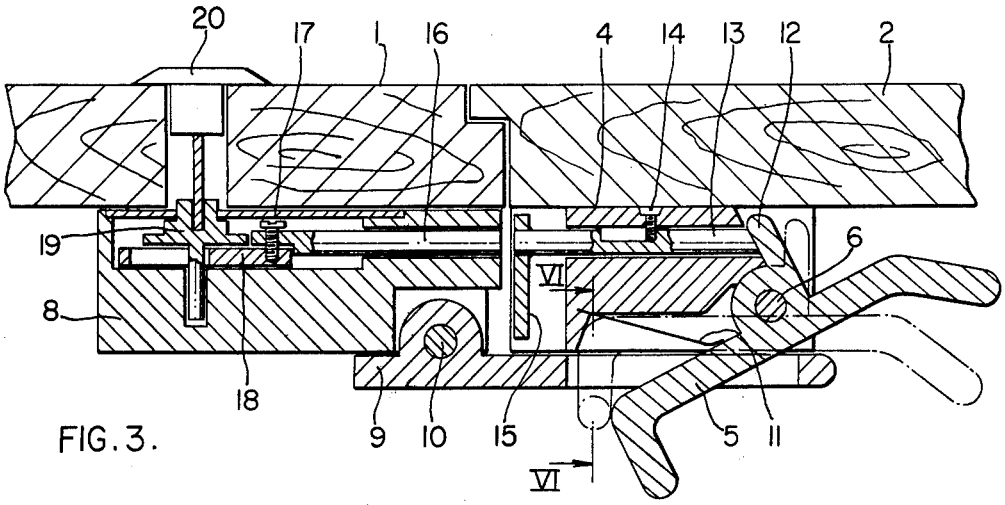
FIG. 3 is a longitudinal sectional view.

Referring to FIGS. 1 to 3, reference 1 shows the door, and reference 2 shows the stationary door frame on which a supporting block 4 is secured by means of screws 3 or the like, which block 4 mounts a rocking arm 5, pivoted at 6.

Another block 8 is secured to door 1 by screws 7, which block supports an eyed rod 9, which together with rocking arm 5, form the safety-hook.

Rod 9 is pivoted at 10 in respect of mounting block 8 and it can rotate only counterclockwise of the latter, as can easily be viewed from FIG. 3. In turn, rocking member 5 can rotate clockwise only against the bias of a spring 11, biasing the same toward the position illustrated in solid line in FIG. 3. In this position, the nose portion 12 on rocking member 5 is pushed against piston 13 slidingly received in block 4, with a stroke defined by guiding screw 14, piston 13 having an end plate 15 secured thereto.

A rod 16, is mounted on block 8, aligned with piston 13, which rod 16 is pivoted on a rocking plate 18, operated by a cylinder 19 of a "Yale" type lock.

Eyed rod 9 has a slot 21 in which rocking member 5 can slide. In turn, rocking member 5 has, on one end, a transversal element 22 that can pass through window 23 on rod 9, as will be better described below.

Figure 4:
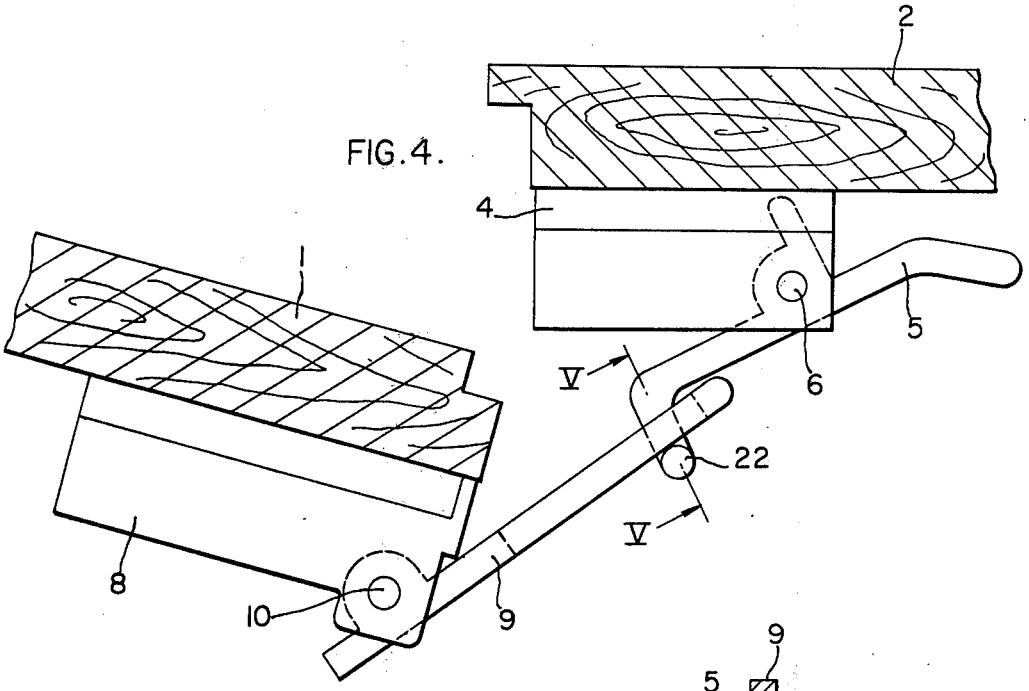
FIG. 4 is a similar view to FIG. 3, showing the door opening, the hook being hooked.
Figure 5:
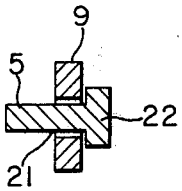
FIG. 5 is a sectional view on the line V—V of FIG. 4.

The operation of the device is as follows:

The hook is normally always hooked and consequently the hook device appears as illustrated in FIGS. 1, 2 and 3. Upon opening of door 1, rod 9 describes a circular arc, transversal element 22 of rocking member 5 strikes against the edges of slot 21, sliding until a locked engagement is reached, as illustrated in FIGS. 4 and 5.

In this condition, there is a small opening between the door and the door frame, wide enough to observe the ringing person.

If it is desired to open the door completely, it is sufficient to close completely the door and rotate rocking member 5 clockwise, until the position illustrated by dotted line in FIG. 3.

Figure 6:
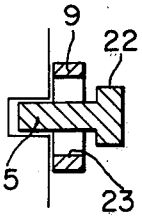
FIG. 6 is a sectional view on the line V—V of FIG. 3.

In this position (see also FIG. 6) transversal element 22 of rocking member 5 can go through window 23 of rod 9 and the door can be fully opened.

As soon as the door is closed again, rocking member 5 and 9 engage automatically, restoring the operating position of the hook device.

Where it is desired to open the door completely from outside, before unlocking the main lock (or locks), lock 20 must be unlocked. This unlocking causes rod 16 to slide to the right, viewing FIG. 3, until it pushes piston 13 which, in turn, acting on nose 12, rotates rocking member 5 to the disengaged position, as already described above.

This invention has been described and illustrated by a preferred embodiment thereof; however it is understood that, in practice, construction modifications can be made thereto without going out of the scope of the invention.

I claim:

1. An automatic hooking safety hook for securing a door pivotally mounted in a door frame and normally openable in an arc about a point lying substantially in the plane of the door frame, said safety hook comprising:

a rocking member having an engaging end and adapted for attachment to a door frame for pivotal movement in a plane substantially perpendicular to the plane of the door frame between a disengaging position, in which said engaging end is positioned adjacent the door frame, and an engaging position, in which said engaging end is pivoted away from the door frame;

an eyed member adapted for attachment to a door and including means for receiving said rocking member engaging end;

bias means for biasing said rocking member engaging end away from the door frame toward its engaging position to retain said engaging end engaged within said receiving means;

first actuating means operable from inside the door for pivoting said rocking member engaging end toward the door frame to its disengaging position to permit release of said engaging end from said receiving means; and second actuating means operable from outside the door for pivoting said rocking member engaging end toward the door frame to its disengaging position to permit release of said engaging end from said receiving means.

2. A safety hook as claimed in claim 1 in which said rocking member comprises an elongated arm member, said engaging end comprises a transverse element at one end of said arm member and said first actuating means comprises the second end of said arm member.

3. A safety hook as claimed in claim 2 in which said eyed member comprises an elongated rod and said receiving means comprises an opening through said rod.

4. A safety hook as claimed in claim 3 in which said opening includes an elongated slot portion, sized for passage of said arm member therethrough while preventing passage of said transverse element therethrough, and a window portion, sized for passage of said transverse element therethrough.

5. A safety hook as claimed in claim 1 in which said eyed member comprises an elongated rod and said receiving means comprises an opening through said rod.

6. An automatic hooking safety hook for a door comprising:

a rocking member having an engaging end and adapted for attachment to a door frame for pivotal movement between a disengaging position, in which said engaging end is positioned adjacent the door frame, and an engaging position, in which said engaging end is pivoted away from the door frame;

an eyed member adapted for attachment to a door and including means for receiving said rocking member engaging end;

bias means for biasing said rocking member toward its engaging position to retain said engaging end engaged within said receiving means;

first actuating means operable from inside the door for pivoting said rocking member to its disengaging position to permit release of said engaging end from said receiving means;

second actuating means operable from outside the door for pivoting said rocking member to its disengaging position to permit release of said engaging end from said receiving means; and means for pivotally connecting said eyed member to the door for pivotal movement between a first position substantially parallel with the surface of the door and a second position oriented at an angle with respect to the surface of the door to permit partial opening of the door while retaining said rocking member engaging end received within said receiving means.

7. A safety hook as claimed in claim 6 in which said rocking member comprises an elongated arm member, said engaging end comprises a transverse element at one end of said arm member and said first actuating means comprises the second end of said arm member.

8. A safety hook as claimed in claim 7 in which said eyed member comprises an elongated rod and said receiving means comprises an opening through said rod.

9. A safety hook as claimed in claim 8 in which said opening includes an elongated slot portion, sized for passage of said arm member therethrough while preventing passage of said transverse element therethrough, and a window portion, sized for passage of said transverse element therethrough.

10. An automatic hooking safety hook for a door comprising:

a rocking member having an engaging end and adapted for attachment to a door frame for pivotal movement between a disengaging position, in which said engaging end is positioned adjacent the door frame, and an engaging position, in which said engaging end is pivoted away from the door frame;

an eyed member adapted for attachment to a door and including means for receiving said rocking member engaging end;

bias means for biasing said rocking member toward its engaging position to retain said engaging end engaged within said receiving means;

first actuating means operable from inside the door for pivoting said rocking member to its disengaging position to permit release of said engaging end from said receiving means;

a piston mounted for sliding movement between a first position, permitting pivoting of said rocking member between the disengaging position and the engaging position, and a second position in which said piston pivots said rocking member to the disengaging position against the bias of said bias means; and keyed lock means operable from outside the door for moving said piston from its first position to its second position.

* * * * *